United States Patent [19]

Cochran

[11] 4,131,160

[45] Dec. 26, 1978

[54] WELL TOOL WITH PRESSURE RESPONSIVE TIGHTENING MEANS

[75] Inventor: Chudleigh B. Cochran, Houston, Tex.

[73] Assignee: Brown Oil Tools, Inc., Houston, Tex.

[21] Appl. No.: 818,583

[22] Filed: Jul. 25, 1977

[51] Int. Cl.[2] ..... E21B 33/128; E21B 33/129

[52] U.S. Cl. ..... 166/120; 166/182

[58] Field of Search ..... 166/120, 121, 182

[56] References Cited

U.S. PATENT DOCUMENTS

| | | | |
|---|---|---|---|
| 3,279,542 | 10/1966 | Brown | 166/139 |
| 3,357,489 | 12/1967 | Brown | 166/139 |
| 3,412,801 | 11/1968 | Young | 166/120 |
| 3,426,846 | 2/1969 | Young | 166/120 |
| 3,467,184 | 9/1969 | Young | 166/129 |
| 3,508,610 | 4/1970 | Kisling | 166/120 |
| 3,552,489 | 1/1971 | Berryman | 166/120 |
| 4,018,274 | 4/1977 | Cochran | 166/129 |

*Primary Examiner*—Ernest R. Purser

*Attorney, Agent, or Firm*—Browning, Bushman & Zamecki

[57] ABSTRACT

A well tool for use in a tubular well conduit comprising a tool body including at least one radially extendable element for engaging the well conduit, and first and second tool body portions. The tool body portions are operatively associated with the radially extendable element and relatively movable longitudinally toward each other to extend the radially extendable element. Such movement is effected by longitudinal movement of a mandrel assembly which is engageable with the second tool body portion whereby they together form an actuator. The tool further comprises lock means cooperative between the actuator and the first tool body portion to limit movement of the tool body portions away from each other thereby locking the radially extendable element in its extended position. Tightening means associated with the lock means tightens the lock means responsive to fluid pressure acting in a direction opposite the direction of movement of the actuator during setting. The same or similar pressure responsive means may also serve to resist movement of the first tool body portion during setting.

23 Claims, 8 Drawing Figures

WELL TOOL WITH PRESSURE RESPONSIVE TIGHTENING MEANS

BACKGROUND OF THE INVENTION

1. Field of the Invention

The present invention relates to the field of downhole tools and, more particularly, to tools such as anchors, packers, etc. which have radially extendable elements for engaging the casing, well bore, or other well conduit. A typical packer, for example, includes a resilient packer element, formed of a suitable elastomer, which may be radially expanded to seal against the surrounding well conduit. Many packers also include an anchor assembly having radially extendable slips or other anchor elements for gripping the well conduit to hold the tool in a desired position. However, such anchors may also be incorporated in other types of tools.

Tools of the type described above may be generally classified according to the manner in which they are set and/or released. One broad category consists of hydraulic set tools in which the radially extendable elements are extended by pumping a suitable fluid down through the drill string or operating string on which the tool is supported. Another broad category consists of mechanically set packers, and these may be sub-divided into those which are set by rotary movement of the operating string and those which are set by strictly linear movement of the operating string. Of the latter sub-division, those which are set by downward movement of the drill string are generally referred to as "weight set" since the downward movement is usually effected by partially releasing the means supporting the string and allowing its own weight to carry it downwardly.

Each of these general types of tools has its own advantages over the other types. One of the primary advantages of the tools which are set by linear movement, and particular "weight set" tools, is their simplicity of construction and operation.

DESCRIPTION OF THE PRIOR ART

Most packers, and particularly those of the weight set variety, require a lock means to retain the radially extendable means in its extended or set position. U.S. Pat. No. 3,467,184 and No. 4,018,274 show packers in which the radially extendable means are set by lowering the mandrel until it engages an uppermost part of the tool and then continuing to lower the mandrel thereby moving such upper part downwardly toward a lowermost part of the tool. Latch means on the lower tool part then engage the upper part to prevent retraction thereof, even upon subsequent limited upward movement of the mandrel.

In the packers shown in U.S. Pat. No. 3,357,489 and No. 3,279,542, the manner of setting is similar. However, in these structures, the latch means engages the mandrel so that it is locked in a lower position and the upper tool part is retained in its lower position via the mandrel.

SUMMARY OF THE INVENTION

The present invention pertains to mechanically set tools of the type described above. Although the invention is particularly applicable to weight set tools, it may advantageously be applied to tools which are set in another manner, e.g. by a straight pull on the operating string, by rotary motion, etc.

A tool according to the present invention comprises a tool body including radially extendable means and first and second tool body portions. The radially extendable means may be an elastomeric packer element and/or a set of anchor elements such as slips. The first and second tool body portions are operatively associated with the radially extendable means and relatively movable longitudinally toward each other to extend the radially extendable means. The first tool body portion has means associated therewith operative to resist movement of the first tool body portion with respect to the well conduit in a first longtudinal direction, preferably downwardly.

The tool further comprises a mandrel assembly which is connected to the operating string and extends through the tool body. The mandrel assembly is movable with respect to the first tool body portion in the downward direction and includes means engageable with the second tool body portion to move the second tool body portion downwardly jointly with the mandrel assembly whereby the mandrel assembly and second tool body portion form an actuator to extend the radially extendable means.

Lock means cooperative between the actuator and the first tool body portion serve to limit movement of the first and second tool body portions away from each other. If the lock means is directly cooperative with the mandrel, it may also lock the mandrel assembly itself against longitudinal movement, in at least one direction, with respect to the tool body, which in turn is fixed in the well conduit by the radially extendable means.

The tool of the invention includes novel tightening means associated with the lock means for tightening the lock means responsive to fluid pressure acting in a direction opposite to the direction of movement of the mandrel during setting, e.g. upwardly in the above example. Ordinarily, the well pressure below the set packer is greater than that above the packer. This pressure may act on the tool body to tend to unseat the same and/or on the mandrel to cause it to move upwardly within the tool body. Through the use of the present invention, this very pressure may be utilized by the tightening means to tighten the lock means which ultimately resists movements of the tool and/or mandrel responsive to such pressure.

In the preferred forms of the invention, the lock means comprises a locking element carried by the first tool body portion for limited radial and longitudinal play therebetween. The locking element and the mandrel have interengageable locking surfaces, and the locking element and first tool body portion have longitudinally and radially inclined wedging surfaces for urging the locking element toward the mandrel. The first tool body portion is also preferably comprised of two componenets interconnected for limited telescopic play, the locking element being carried by one and the wedge surface of the first tool body portion being formed on the other. Then if the latter component has a pressure reaction area thereon responsive to fluid pressure in the well below the packer acting upwardly, it may serve as the tightening means.

Also in the preferred embodiments, the tool body includes an intermediate tool body portion disposed between the first and second tool body portions for limited telescopic movement with respect to each of the other tool body portions. The intermediate tool body portion interconnects the first and second tool body portions for transmission of longitudinal forces therebetween. The intermediate tool body portion may comprise one or more elements, including the radially extendable means themselves, which are further longitudinally movable with respect to each other. This permits the movements of the second tool body portion to extend or set both the seal element and the anchor elements even though the two are longitudinally spaced from each other along the tool body.

The tool comprises releasable retainer means, such as a J-slot assembly, cooperative between the mandrel and the first tool body portion to prevent pre-mature extension of the seal and/or anchor elements during running-in by selectively restricting relative movement between the mandrel and the first tool body portion. Accordingly, the tool body is preferably provided with radially resilient means, such as a plurality of drag springs or a plurality of spring loaded drag blocks, to frictionally engage the well conduit and permit the J-slot assembly to be released. These friction means may be carried by the first tool body portion in which case they may also serve as at least a part of the means for restricting movement of the first tool body portion in the first or downward direction during setting of the tool. However, such movement resisting means may also comprise a pressure reaction area on the first tool body portion, and in preferred embodiments, this may be the same area which functions in the lock tightening action of the first tool body portion.

Accordingly, it is a principal object of the present invention to provide an improved tool of the type having radially extendable means for engaging a well conduit, lock means, and pressure responsive tightening means therefor.

A further object of the invention is to provide such a well tool adapted to utilize the fluid pressure in the well conduit as at least a part of the motion resistive force necessary for setting the tool.

Still another object of the invention is to provide an improved mechanically set packer.

Still other objects, features and advantages of the invention will be made apparent by the following description of the preferred embodiments, the drawings and the claims.

DESCRIPTION OF THE PREFERRED EMBODIMENTS

Figure 1:
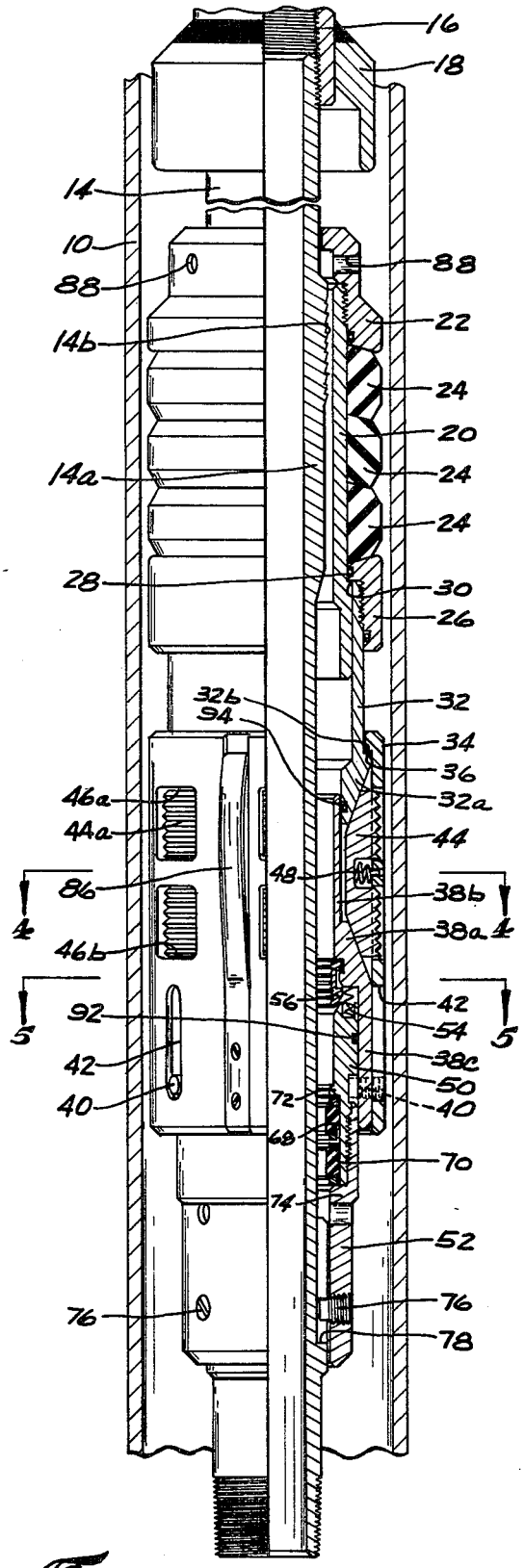
FIG. 1 is a longitudinal quarter-sectional view of one embodiment of the invention in released condition.

Referring now to the drawings, a first embodiment of the invention in the form of a packer is shown in FIGS. 1, 2 and 4–8. The tool is shown as used in a well casing 10 although it will be understood that similar tools can be used to engage the walls of the uncased well bores as well as other types of well conduits. The tool comprises a mandrel assembly (which may be referred to herein simply as the "mandrel") including upper and lower sections 12 and 14 connected by a collar 16. The mandrel assembly also includes a bonnet 18 welded to the collar 16 and having a downwardly depending annular flange. Lower mandrel section 14 has an upset portion **14*a* of increased outer diameter, a portion of which is provided with upwardly inclined threads 14*b*. Upper mandrel section 12 is connected to a string of drill pipe (not shown) in a conventional manner, and lower mandrel section 14** has its lower end provided with a threaded pin for connection to additional sections of drill pipe as required.

The tool further comprises a generally tubular tool body which is carried by the mandrel assembly and through which the mandrel assembly extends. The tool body includes an upper thimble comprised of an annular sleeve 20 having an annular upper packer head 22 threadedly connected to its upper end and extending radially outwardly therefrom to form a downwardly directed shoulder. This shoulder abuts the uppermost one of a set of annular elastomeric packer elements 24 surrounding the sleeve 20 below head 22 and carried by sleeve 20 in end to end abutment with one another. The lower end of sleeve 20 is slidably telescopically received within a lower annular packer head 26. Sleeve 20 is sealed with respect to each of the heads 22 and 26 by respective O-rings. The lower head 26 forms an upwardly directed shoulder which abuts the lowermost one of the packer elements 24. Thus if the head 26 and thimble 20, 22 are telescopically contracted, the elastomeric packer element 24 will be compressed between the two heads 22 and 26 and, being restrained against radially inward expansion by the sleeve 20, will be radially outwardly extended to contact and seal against the well casing 10. Sleeve 20 and lower packer head 26 have respective opposed axially directed shoulders 28 and 30 which limit telescopic extension of the thimble 20, 22 and head 26.

A sleeve 32 is threadedly connected to the lower end of lower head 26 and sealed thereto by an O-ring. The lower end of sleeve 32 forms an upper expander **32*a* for the anchor assembly of the tool body. Upper expander 32*a* has a conical outer surface tapered downwardly and radially inwardly and is telescopically recieved in the upper end of a generally cylindrically slip cage 34. An external annular upwardly directed shoulder 32*b* is formed at the upper extremity of the expander 32*a* and opposes an internal downwardly directed shoulder 36 in slip cage 34. Shoulders 32*b* and 36 are engageable to limit telescopic extension of sleeve-expander 32, 32*a* and slip cage 34**.

A lower expander **38*a* is disposed within slip cage 34 below the upper expander 32*a*. Expander 38*a* also has a conical external surface which is tapered upwardly and radially inwardly. A sleeve 38*b* formed integrally with expander 38*a* extends upwardly therefrom. Sleeve 38*b* is slidably telescopically recieved within expander 32*a* and is sealed with respect thereto by an O-ring. A second sleeve 38*c*, also formed integrally with expander 38*a*, extends downwardly from the radially outer portion thereof to slidably telescopically engage the interior of the lower portion of slip cage 34. A plurality of pins 40 extend radially outwardly from sleeve 38*c* and ride in vertically elongated slots 42 in the slip cage 34**.

This limits the telescopic movement of the expander and sleeves 38*a*, 38*b*, 38*c* with respect to the slip cage 34.

Mounted within the slip cage 34 are a plurality of anchor elements or slips 44. Each slip 44 has upper and lower sets of teeth 44*a* and 44*b* formed on its radially outer surface, each set of teeth being aligned with a respective window 46*a* or 46*b* in the slip cage 34. Between its two sets of teeth 44*a* and 44*b*, each slip 44 is provided with a radially inwardly extending recess for receipt of a compression spring 48. The springs 48 bear against the inner surface of cage 34 to bias the slips 44 radially inwardly. However, if the expanders 32*a* and 38*a* are telescopically contracted toward each other their conical outer surfaces cam the slips 44 radially outwardly so that their teeth 44*a* and 44*b* protrude from the windows 46*a* and 46*b* to engage the casing 10 and fix the tool body with respect thereto. Each slip 44 has its radially inner surface downwardly and inwardly inclined at the upper end and upwardly and inwardly inclined at the lower end to mate with the conical surfaces of expanders 32*a* and 38*a* respectively and thereby facilitate the camming action.

The sleeve 38*c* has disposed therein the upper end of a lowermost tool body component comprised of a pair of generally tubular elements 50 and 52 threadedly connected to each other. The pins 40 which connect sleeve 38*c* to the slip cage 34 also extend radially inwardly from sleeve 38*c* and into oversized bores in element 50. Thus the component 50, 52 is connected to sleeve 38*c* for limited longitudinal play. Element 50 is sealed against the inner surface of sleeve 38*c* by an O-ring. Component 50, 52 is biased downwardly with respect to sleeve 38*c* by compression springs 54 disposed between the lower end of expander 38*a* and the upper end of element 50.

Figure 2:
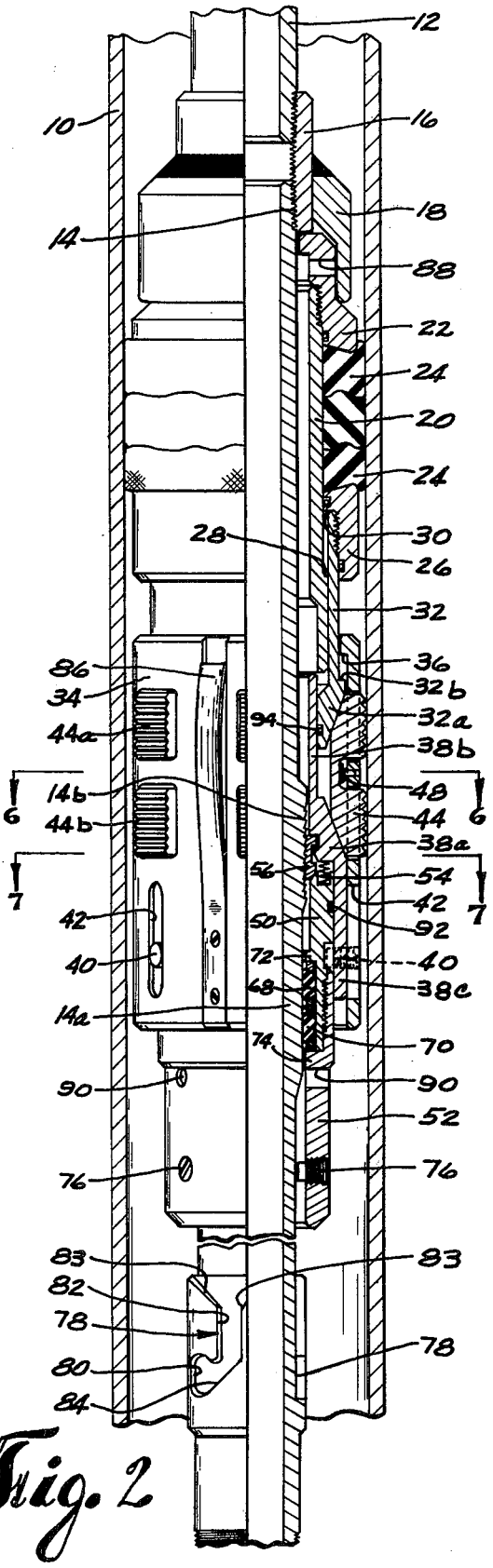
FIG. 2 is a longitudinal quarter-sectional view of the tool of FIG. 1 in set condition.
Figure 5:
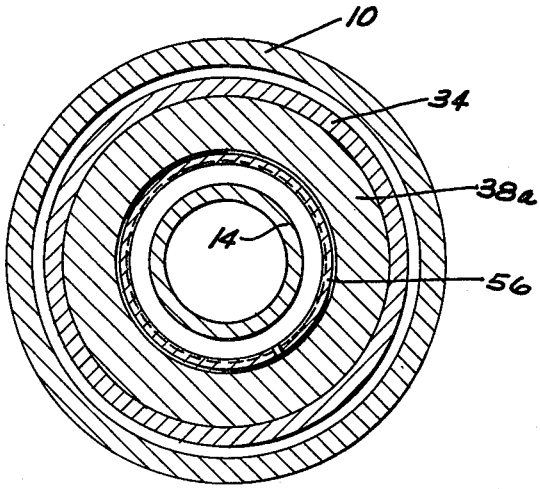
FIG. 5 is a transverse cross-sectional view taken on line 5—5 of FIG. 1.
Figure 8:
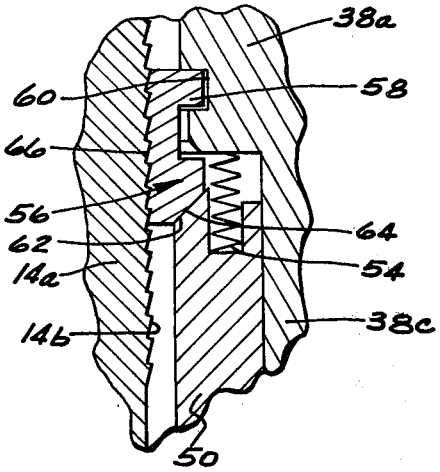
FIG. 8 is an enlarged detailed view of the lock ring and related parts in the positions of FIG. 2.
Figure 7:
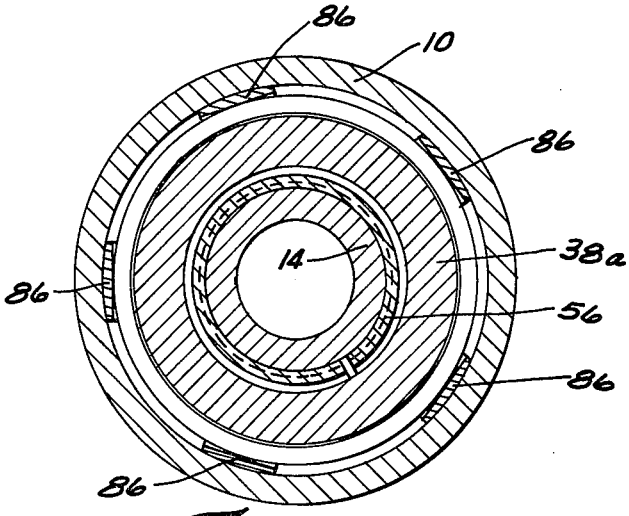
FIG. 7 is a transverse cross-sectional view taken on line 7—7 of FIG. 2.

Referring to FIGS. 1, 2 and 8, a lock ring 56 is carried on the radially inner side of the component formed by expander 38*a* and its integral sleeves 38*b* and 38*c* by an annular flange 58 which extends radially outwardly into an internal annular recess 60 in expander 38*a*. Recess 60 is oversized with respect to flange 58 to permit limited longitudinal play therebetween. Additionally, as best seen in FIGS. 5 and 7, ring 56 is a split ring whereby radial play is also permitted. The lower end of ring 56 extends downwardly into alignment with the upper end of element 50, and the opposed portions of the outer surface of ring 56 and the inner surface of element 50 are downwardly and radially bevelled to form mating wedge surfaces 62 and 64, respectively. Thus if element 50 is urged upwardly with respect to component 38*a–c*, against the bias of springs 54, the lock ring 56 may be urged radially inwardly, such movement being permitted by the play provided between element 50 and sleeve 38*c* and between ring 56 and component 38*a–c*. Ring 56 has its radially inner surface provided with downwardly inclined threads 66.

A seal assembly is carried on the interior of component 50, 52. The seal assembly comprises a pair of resilient seal rings 68 and 70 disposed longitudinally adjacent each other and each having a pair of metal retainer rings disposed at its opposite ends. The entire seal assembly is retained between a pair of internal annular flanges 72 and 74 formed on elements 50 and 52 respectively.

Figure 4:
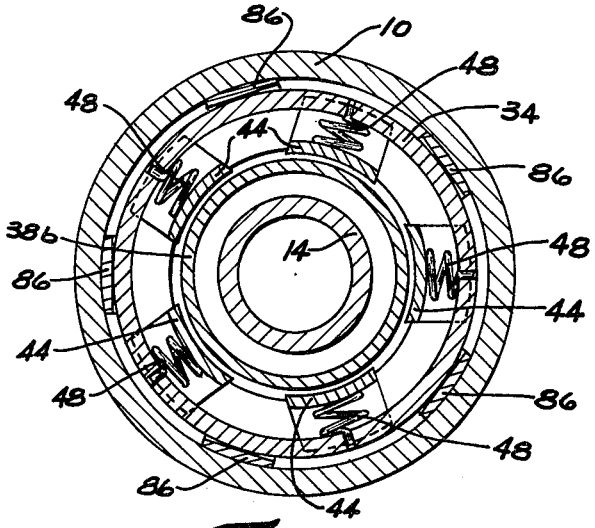
FIG. 4 is a transverse cross-sectional view taken on line 4—4 of FIG. 1.

FIGS. 1, 4 and 5 show the tool in the released condition which is assumed during running-in and retrieval. The various parts of the tool body are disposed in their telescopically extended positions and are held in those positions by the resiliency of the radially retracted packer elements and by the springs 48 which hold the slips 44 in their retracted positions. Also, in released condition, there is an annular clearance space between the mandrel assembly and the tool body from a set of radial ports 88 in head 22 to a set of radial ports 90 in element 52. This space, along with the ports 88 and 90, provide a passageway through the tool for pressure equalization.

In order to retain the mandrel assembly 12–18 against longitudinal movement with respect to the tool body and thereby prevent premature setting of tool during running in, a J-slot assembly is provided between the mandrel section 14 and the tool body element 52. The J-slot assembly includes three J-slots 78 formed on the exterior of the mandrel section 14 and each receiving a respective pin 76 extending radially inwardly from tool body element 52.

During running-in, each pin 76 is disposed in the horizontal leg 80 (see FIG. 2) of its respective slot. Thus no substantial longitudinal movement between the mandrel assembly and the tool body is permitted, and the tool body moves downwardly in the well with the mandrel assembly. When the tool has reached the desired location, the mandrel is raised slightly to engage the pins 76 with the inclined surfaces 84 of the slots 78. The mandrel is then rotated, and the surfaces 84 guide the pins 76 into the vertical legs 82 of their respective slots. The relative rotation between the mandrel assembly and the tool body is permitted by virtue of radially resilient means on the tool body frictionally engaging the interior of the well casing 10 to resist movement of the tool body with respect thereto. In particular, such resistance is provided by a plurality of drag springs 86 carried on the exterior of the slip cage 34. Each of the springs 86 is an outwardly convex leaf spring having one end pinned to the slip cage and the other end free to slide longitudinally in a groove on the slip cage. Thus the springs 86 can be compressed radially inwardly by the well casing to provide the necessary frictional resistance to movement. Since the slip cage 34 is prevented from rotating relative to the tool body element 52 by virtue of pins 40, rotation of the element 52 is effectively resisted by the springs 86, and the mandrel may be rotated with respect to element 52 as indicated above.

With the pins 76 in the vertical legs 82 of slots 78, the mandrel assembly is lowered so that the pins 76 pass completely out of the open upper ends of legs 82. Such downward movement of the mandrel assembly with respect to the element 52 is permitted by the fact that element 52 is suspended from slip cage 34 via pins 40 and downward movement of slip cage is resisted by the springs 86.

The tool can now be set by continued downward movement of the mandrel assembly. Although, as mentioned above, some longitudinal play is permitted between the tool body component formed by expander 38*a* and its integral sleeves 38*b* and 38*c* and the tool body component formed by the threadedly connected elements 50 and 52 by virtue of the loose fit of pins 40 in element 50, these components are generally constrained to move as a unit and may be considered the first tool body portion of the device. The thimble formed by sleeve 20 and packer head 22 may similary be considered a second portion of the tool body. It can be seen that if the second tool body portion 20, 22 is moved toward the first tool body portion 38*a–c*, 50, 52 while the latter is held stationary, the remaining components of the tool will be longitudinally contracted and the packer elements 24 and slips 44 radially extended.

In particualar, as the mandrel assembly begins to move downwardly in the well, the tool body will initially be held fixed by engagement of the springs 86 on the slip cage 34 with the well casing 10. The bonnet 18 will thereby be brought into engagement with the thimble 20, 22 which will then be constrained to begin moving downwardly with the mandrel. Thus the jointly moving mandrel and thimble may be considered a tool actuator. Initial downward movement of the thimble may or may not begin to compress the packer elements 24 depending on their resilient strength. In any event, at such time either before or during the compression of packer elements 24 that their resiliency begins to sufficiently resist relative movement of the thimble 20, 22, the packer elements 24 will begin to move downwardly with the thimble. This in turn will force the abutting head 26 and attached sleeve 32 with its expander **32*a* downwardly camming the upper ends of the slips 44** radially outwardly.

Up until this point, the springs 86, will have prevented downward movement of the first tool body portion **38*a–c*, 50, 52 which is suspended from the slip cage 44. When the upper ends of the slips 44 have engaged the casing 10, further radial extension will be resisted and the slips 44 will begin to move downwardly along with the cage 34. However, by this time the enlarged diameter portion 14*a* of the mandrel section 14 will have been brought into alignment with and engaged by the seal rings 68 and 70. Thus the first tool body portion 38*a–c*, 50, 52 will present an annular pressure reaction area extending from the inner diameter of seals 68, 70 to the outer diameter of O-ring 92 exposed to the fluid pressure within the well below the tool. The same pressure reaction area is also exposed to pressure from above the tool leaking past bonnet 18, through ports 88 and through the annular space between the mandrel and tool body. However, since by this time, the packer elements 24 have sealingly engaged casing 10**, the pressure below the tool will ordinarily be greater than that above the tool. Thus the former pressure will now serve to resist downward movement of the first tool body portion while the mandrel assembly and the remainder of the tool body move downwardly with respect thereto.

Figure 6:
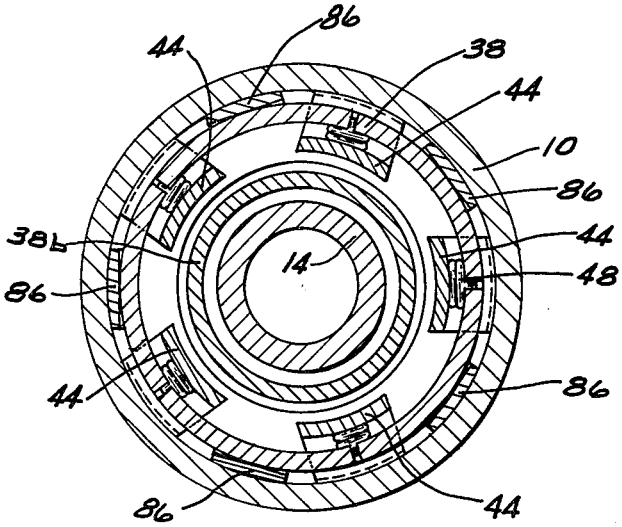
FIG. 6 is a transverse cross-sectional view taken on line 6—6 of FIG. 2.

The slips 44 and slip cage 34 will now move downwardly over the lower expander **38*a* whereby the lower halves of the slips 44 are radially extended. Further downward movement of the mandrel assembly will then serve to further compress the packer elements 24 and more firmly urge the teeth 44*a* and 44*b* of the slips 44 into the casing 10 until the tool is in fully set condition as illustrated in FIGS. 2, 6 and 7**.

Parts 24, 26, 32, 34, and 44 all comprise an intermediate portion of the tool body which interconnects the first and second tool body portions. Furthermore, during setting, as the parts of the intermediate tool body portion are successively longitudinally contracted with respect to each other, each serves to transmit a downward force from the second tool body portion 20, 22 to the parts below and ultimately to the first tool body portion **38*a–c*, 50, 52 thereby providing for setting of the packer elements 24 as well as the slips 44**.

Just prior to complete setting of the packer, the threads **14*b* of the mandrel section 14 approach the threads 66 of the lock ring 56. Since the threads 14*a* are upwardly inclined and the threads 66 downwardly inclined, and since lock ring 56 is mounted for radial and longitudinal play with respect to the component 38*a–c* of the first tool body portion, the threads 14*b* can ratchet downwardly past the threads 66. However, if the mandrel should tend to move upwardly or the first tool body portion 38*a–c*, 50, 52 to move downwardly, the threads 14*b* and 66 will grippingly engage each other to prevent such movement. Thus, with the tool body firmly anchored against the well casing and the mandrel assembly locked against upward movement with respect to the tool body, upward movement of the mandrel assembly by pressure within the well below the tool is effectively prevented. At the same time, the first and second tool body portions are prevented from moving longitudinally away from each other by their interengagement with the mandrel assembly. In particular, the first tool body portion 38*a–c*, 50, 52 is prevented from moving downwardly by the lock rings 56, while the second tool body portion 20, 22 is prevented from moving upwardly by the bonnet 18. The lock ring 56** therefore not only locks the mandrel assembly against upward movement but also locks the tool in set condition.

As noted above, when the tool is set, the seal rings 68 and 70 sealingly engage the enlarged diameter portion **14*a* of the mandrel section 14. This closes off the pressure equalizing passage between the mandrel and tool body. A complete seal is thereby formed between the mandrel assembly (and therefore the operating string) and the well casing by the seals 68, 70, the packer elements 24, and the various O-rings sealing between the telescoping parts of the tool body. The downwardly depending flange of bonnet 18 covers the ports 88** to prevent cuttings and the like from entering the tool body.

As also mentioned above, the area of the first tool body portion between the inner diameter of seals 68 and 70 and the outer diameter of O-ring 92 forms an annular pressure reaction or piston area exposed to fluid pressure within the well below the packer. This pressure reaction area is formed on the lowermost component of the first tool body portion, i.e. the component formed by elements 50 and 52. As previously noted, this component is mounted for limited longitudinal play with respect to the other component **38*a–c*. The well pressure can therefore urge component 50, 52 upwardly against the bias of springs 54. Such movement will wedge the lock ring 56 more firmly radially inwardly against the mandrel assembly by virtue of the mating bevelled surfaces 62 and 64**. Thus the tool is adapted to utilize the well pressure to enhance the locking action.

When it is desired to release the tool, an upward force must be exerted on the mandrel assembly sufficient to overcome the gripping action of the threads **14*b* and 66 and force the threads 14*b* past the lock ring 56. As explained above, the well pressure below the tool, being ordinarily greater than that above the tool, enhances the locking action. Therefore such downhole pressure may, in some instances, provide undue resistance to release of the tool. If this is the case, fluid may be pumped into the well along the exterior of the operating string. Such fluid will leak past the bonnet 18, through ports 88, through the annular space between the mandrel and the tool body, and past the lock ring 56 to exert a downward force on the pressure reaction area of component 50, 52**. This offsets the upward force of the downhole pressure thereby permitting the necessary upward movement of the mandrel assembly to release the tool.

As the mandrel assembly is pulled upwardly, the various parts of the tool body are longitudinally extended with respect to one another in a reversal of the contraction which occurs during setting. Such extension is limited by the various shoulders mentioned above interengageable between contiguous parts. The pins 76 are then preferably worked back into the J-slots 78 by continued upward movement of the mandrel assembly. Flared surfaces 83 serve to guide the pins into their respective slots. When the pins strike the tapered surfaces 84, the mandrel may be rotated slightly to guide the pins into the horizontal legs 80. The tool may then be retrieved from the well.

Figure 3:
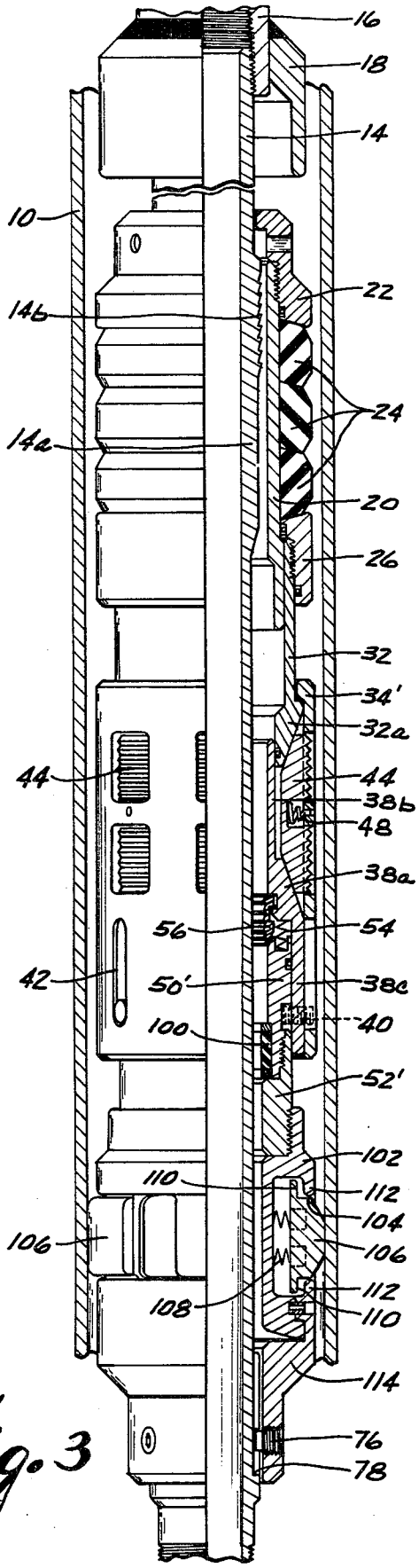
FIG. 3 is a longitudinal quarter-sectional view of a second embodiment of the invention in released condition.

Referring now to FIG. 3, there is shown a second embodiment of the invention. The majority of the parts of the tool of FIG. 3 are identical with the corresponding parts of the first embodiment and have been given identical reference characters. The two embodiments differ primarily in the form of radially resilient friction means which engage the casing 10 to permit release of the J-slot assembly. In the embodiment of FIG. 3, no drag springs are provided on the simplified slip cage 34' which, except for the omission of these springs and the slots in which they ride, is identical to cage 34.

Instead, the lowermost component of the first tool body portion is modified to include a pair of threadedly connected elements 50' and 52', generally corresponding to the elements 50 and 52 of the first embodiment, and a drag block assembly. The drag block assembly includes a housing 102 which is threadedly connected to the bottom of element 52'. Housing 102 has a plurality of circumferentially spaced windows 104 in which are slidably mounted respective drag blocks 106. The blocks 106 are biased radially outwardly by springs 108 interposed between the respective blocks and the housing 102. Each of the blocks 106 has a pair of longitudinally outwardly extending flanges 110 formed at its inner extremity, one such flange extending upwardly and one downwardly. These flanges limit radial extension of the blocks 106 by engagement with opposed longitudinally inwardly extending lips 112 formed on the housing 102. To complete the first tool body portion, a collar 114 is pinned to the lower end of housing 102. Collar 114 carries pins 76 which ride in J-slots 78 on the mandrel section 14 and substantially identical to the J-slots of the first embodiment.

The drag blocks 106 provide the necessary frictional resistance to movement of the first tool body portion to permit the pins 76 to be released from the slots 78 in the same manner as in the first embodiment. However, since the blocks 106 are carried by the first tool body portion per se, they can further serve to resist downward movement of the first tool body portion during the entire setting process, even after the slip cage 34' begins to move downwardly. Thus they enhance the piston-like action of the first tool body portion acting against the well pressure.

The embodiment of FIG. 3 is also modified in that the seal assembly for sealing between the mandrel assembly and the first tool body portion has been simplified. In particular it includes only a single seal ring 100 with a metal retainer ring at each end thereof and disposed between opposed internal annular shoulders on elements 50' and 52' respectively.

Otherwise, the tool of FIG. 3 is substantially identical to the preceding embodiment in both structure and operation, and in particular, the action of its locking ring 56 and the related portions of mandrel 14, element 50' and element 52' are identical.

From the foregoing it can be seen that the present invention provides a relatively simple but highly reliable tool of the type in which radially extendable means must be locked in their extended positions. In particular, the invention provides an improved weight set packer having means responsive to the well pressure therebelow to tighten the lock means resisting movement of various parts of the tool by this same pressure. The tool also provides pressure responsive means for resisting downward movement of the lowermost tool body portion to permit setting.

It can also be seen that numerous modifications may be made in the preferred embodiments shown without departing from the spirit of the invention. For example, in the embodiments shown, the lock means is cooperative between the mandrel and the first tool body portion whereby it not only serves to lock the first and second tool body portions against movement away from each other but also locks the mandrel in a lower position with respect to the tool. However, the invention can also be applied to tools of the type shown in U.S. Pat. No. 4,018,274 and No. 3,467,184 in which the lock means directly engages the second tool body portion to permit independent upward movement of the mandrel.

Additionally, the locking mechanism of the present invention may be employed in packers without anchors as well as in anchors per se which do not include a seal or packer element. Indeed the principles of the invention may be applied to virtually any tool in which radially extendable means must be locked in extended positions. Numerous structural modifications of the various parts of the invention will also suggest themselves to those skilled in the art. For example, the J-slot assembly could be replaced with various other means for preventing premature setting of the tool during running-in. Furthermore, the principles of the invention could be applied to tools in which the longitudinal movement of the mandrel in setting the tool is accompanied by rotary motion, as in a threading type movement. In such instances, the J-slot assembly or its equivalent might be eliminated altogether. Accordingly it is intended that the scope of the invention be limited only by the claims which follow.

I claim:

1. A well tool for use in a tubular well conduit, comprising:

a. a tool body comprising:

i. radially extendable means for engaging the well conduit; and ii. first and second tool body portions operatively associated with said radially extendable means and relatively movable longitudinally toward each other to extend said radially extendable means, said first tool body portion having means associated therewith operative to resist movement of said first tool body portion with respect to the well conduit in a first longitudinal direction;

b. a mandrel assembly extending through said tool body and movable with respect to said first tool body portion in said first direction, said mandrel assembly including means engageable with said second tool body portion to move said second tool body portion jointly with said mandrel assembly in said first direction whereby said mandrel assembly and said second tool body portion form an actuator to extend said radially extendable means;

c. lock means cooperative between said actuator and said first tool body portion to limit movement of said first and second tool body portions away from each other; and d. tightening means associated with said lock means for tightening said lock means responsive to fluid pressure acting in a second direction opposite said first direction.

2. The well tool of claim 1 wherein said lock means comprises a locking element disposed between said actuator and said first tool body portion and carried by one of said actuator and said first tool body portion, said locking element and said other of said actuator or said first tool body portion having interengageable locking surfaces.

3. The well tool of claim 2 wherein said locking element is carried by said first tool body portion for limited radial and longitudinal play therebetween said locking element and said first tool body portion having longitudinally and radially inclined wedging surfaces for urging said locking element toward said mandrel assembly.

4. The well tool of claim 3 wherein said first tool body portion comprises two components interconnected for limited telescopic play, said locking element being carried by one of said components, and said wedge surface of said first tool body portion being formed on the other of said components.

5. The well tool of claim 4 wherein said other component has a pressure reaction area responsive to fluid pressure acting in said second direction to urge said wedge surfaces into engagement.

6. The well tool of claim 5 wherein said first tool body portion further comprises means cooperative between said components to bias said wedge surfaces away from engagement.

7. The well tool of claim 5 wherein said means resisting movement of said first tool body portion in said first direction includes said pressure reaction area.

8. The well tool of claim 5 wherein said pressure reaction area is further responsive to fluid pressure acting in said first direction.

9. The well tool of claim 8 wherein said radially extendable means comprises a resilient packer element, and said tool has a bypass passageway therein providing communication between said pressure reaction area and a section of said well conduit on the opposite side of said packer element from said pressure reaction area.

10. The well tool of claim 1 wherein said locking surfaces of said actuator are formed on said mandrel whereby said lock means is operative to limit movement of said mandrel assembly in said second direction with respect to said first tool body portion.

11. The well tool of claim 1 further comprising releasable retainer means cooperative between said mandrel assembly and said first tool body portion to selectively restrict and permit relative longitudinal movement therebetween.

12. The well tool of claim 11 wherein said retainer means comprises J-slot means cooperative between said mandrel assembly and said first tool body portion.

13. The well tool of claim 11 wherein said tool body includes radially resilient means frictionally engaging the well conduit.

14. The well tool of claim 1 wherein said means resisting movement of said first tool body portion in said first direction includes radially resilient means frictionally engaging the well conduit.

15. The well tool of claim 1 wherein said tool body further comprises an intermediate tool body portion disposed between said first and second tool body portions for limited telescopic movement with respect to each of said first and second tool body portions and interconnecting said first and second tool body portions for transmission of longitudinal forces between said first and second tool body portions.

16. The well tool of claim 15 wherein said intermediate tool body portion includes said radially extendable means.

17. The well tool of claim 16 wherein said radially extendable means includes a plurality of anchor elements for gripping said well conduit.

18. The well tool of claim 17 wherein said intermediate tool body portion includes a cage member, said anchor elements being radially reciprocally mounted in said cage member, said first tool body portion including a first anchor expander, and said intermediate tool body portion including a second anchor expander telescopically movable with respect to said cage member, each of said anchor expanders having cam surfaces engageable with said anchor elements to radially extend said anchor elements as said second anchor expander and said cage member are telescopically moved in said first direction.

19. The well tool of claim 17 wherein said radially extendable means further includes a resilient packer element longitudinally spaced from said anchor elements, and wherein said intermediate tool body portion includes at least one rigid member interposed between said packer element and said anchor elements.

20. The well tool of claim 16 wherein said radially extendable means includes a resilient packer element.

21. A well tool for use in a tubular well conduit, comprising:

a tool body comprising:

radially extendable means for engaging the well conduit; and first and second tool body portions operatively associated with said radially extendable means and relatively movable longitudinally toward each other to extend said radially extendable means;

and a mandrel assembly extending through said tool body and movable with respect to said first tool body portion in a first longitudinal direction, said mandrel assembly including means engageable with said second tool body portion to move said second tool body portion jointly with said mandrel assembly in said first direction toward said first tool body portion whereby said mandrel assembly and said second tool body portion form an actuator to extend said radially extendable means;

and wherein said first tool body portion has a pressure reaction area thereon responsive to fluid pressure acting on said first tool body portion in a second direction opposite the first direction to permit such fluid pressure to urge said first tool body portion in said second direction.

22. The well tool of claim 21 further comprising lock means cooperative between said actuator and said first tool body portion to limit movement of said first and second tool body portions away from each other.

23. The well tool of claim 22 wherein said lock means is cooperative between said mandrel assembly and said first tool body portion to limit movement of said mandrel assembly in said second direction with respect to said first tool body portion.

* * * * *